US010989435B2

(12) United States Patent
Uriarte et al.

(10) Patent No.: US 10,989,435 B2
(45) Date of Patent: Apr. 27, 2021

(54) ADAPTER FOR DIFFUSER AND DUCT CONNECTION

(71) Applicant: CARDINAL IP HOLDING, LLC, Milwaukee, WI (US)

(72) Inventors: Anthony S. Uriarte, Muskegon, MI (US); Peter M. Schmitz, Byron Center, MI (US); Alisha R. Story, Zeeland, MI (US); Mark R. Krug, Grand Rapids, MI (US)

(73) Assignee: Cardinal IP Holding, LLC, Milwaukee, WI (US)

( * ) Notice: Subject to any disclaimer, the term of this patent is extended or adjusted under 35 U.S.C. 154(b) by 461 days.

(21) Appl. No.: 16/135,941

(22) Filed: Sep. 19, 2018

(65) Prior Publication Data

US 2020/0072492 A1 Mar. 5, 2020

Related U.S. Application Data

(60) Provisional application No. 62/727,422, filed on Sep. 5, 2018.

(51) Int. Cl.
*F24F 13/02* (2006.01)
*F24F 13/062* (2006.01)

(52) U.S. Cl.
CPC ..... *F24F 13/0209* (2013.01); *F24F 13/062* (2013.01)

(58) Field of Classification Search
CPC ..... F24F 13/0209; F24F 13/062
See application file for complete search history.

(56) References Cited

U.S. PATENT DOCUMENTS 3,866,950 A * 2/1975 Skoch ..... F16L 21/002 285/4
4,159,674 A * 7/1979 Brumleu, Jr. ..... B32B 5/08 454/297

(Continued)

FOREIGN PATENT DOCUMENTS

AU 2009201108 10/2009
AU 2011200982 10/2011

(Continued)

OTHER PUBLICATIONS

Rectorseal, A CSW Industrials Company, "MV Classic Innovative one piece design. Virtually air tight. Quicker installation.", Website: https://www.rectorseal.com/classic/, Aug. 16, 2018.

*Primary Examiner* — James M Hewitt, II
(74) *Attorney, Agent, or Firm* — Warner Norcross + Judd LLP

(57) ABSTRACT

An adapter for connecting a duct and a diffuser includes a base configured to be coupled to the diffuser and having a central opening. The adapter also includes a radially inner collar directly coupled to the base and extending circumferentially about a longitudinal axis of the central opening. The adapter also includes a radially intermediate collar directly coupled to the base, extending circumferentially about the longitudinal axis, and disposed radially outward from the radially inner collar. The adapter also includes a radially outer collar directly coupled to the base, extending circumferentially about the longitudinal axis, and disposed radially outward from the radially intermediate collar. A height of the radially intermediate collar, measured from the base upwardly, is greater than a height of the radially outer collar, and less than a height of the radially inner collar.

9 Claims, 10 Drawing Sheets

(56) References Cited

U.S. PATENT DOCUMENTS

| | | | | |
|---|---|---|---|---|
| 5,081,914 | A * | 1/1992 | Mejia | F24F 7/02 138/89 |
| 5,109,756 | A | 5/1992 | Barboza et al. | |
| 5,873,496 | A * | 2/1999 | Montaner | B05B 11/3045 222/153.09 |
| 6,478,673 | B1 | 11/2002 | Haynes | |
| 6,557,826 | B2 | 5/2003 | Moore et al. | |
| 6,758,502 | B2 | 7/2004 | Mattsson et al. | |
| 7,022,010 | B1 * | 4/2006 | Cardon | F24F 13/06 454/292 |
| 7,410,416 | B2 | 8/2008 | Fettkether | |
| D607,555 | S * | 1/2010 | Nishizawa | D23/393 |
| 7,685,766 | B2 * | 3/2010 | Amsellem | A01G 27/006 47/48.5 |
| 7,980,266 | B2 | 7/2011 | Niedermair | |
| 8,833,013 | B2 | 9/2014 | Harman | |
| 8,876,582 | B2 | 11/2014 | Gao et al. | |
| 9,945,391 | B2 | 4/2018 | Hausmann | |
| 10,443,768 | B1 * | 10/2019 | McConnell | F16L 25/14 |
| 2008/0007046 | A1 | 1/2008 | Barboza et al. | |
| 2009/0191809 | A1 | 7/2009 | Smith | |
| 2014/0273804 | A1 * | 9/2014 | Glass, Jr. | B29C 45/006 454/310 |
| 2017/0122609 | A1 | 5/2017 | Mantyla et al. | |

FOREIGN PATENT DOCUMENTS

| | | |
|---|---|---|
| GB | 2545891 | 7/2017 |
| GB | 2550319 | 11/2017 |
| WO | 2011066612 | 6/2011 |
| WO | 2017037466 | 3/2017 |

* cited by examiner

FIG. 13
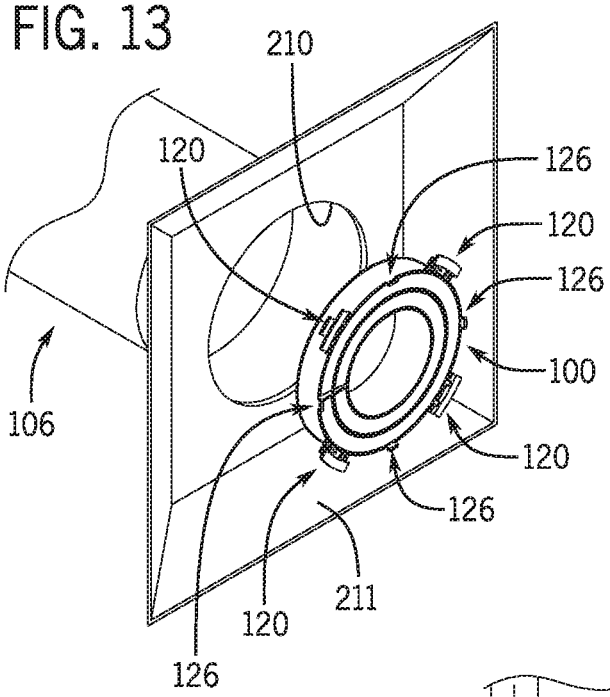
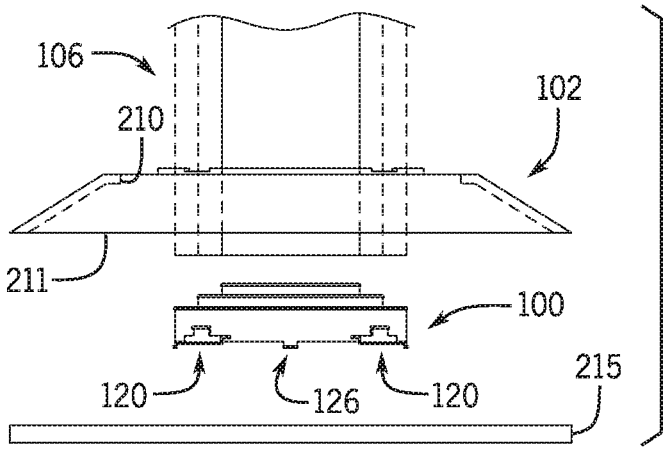
FIG. 14
FIG. 15
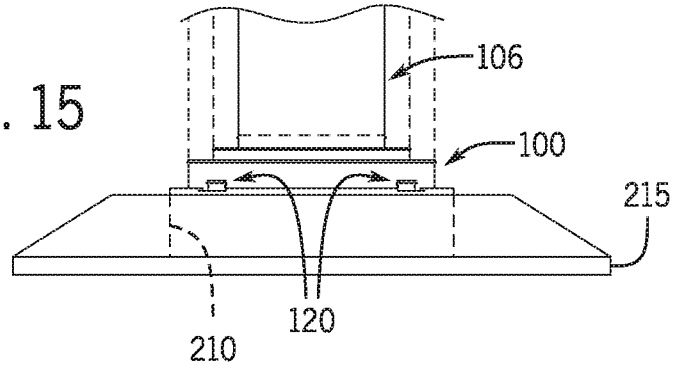

ADAPTER FOR DIFFUSER AND DUCT CONNECTION

CROSS REFERENCE TO RELATED APPLICATIONS

This application claims priority from and the benefit of U.S. Provisional Application Ser. No. 62/727,422, entitled "ADAPTER FOR DIFFUSER AND DUCT CONNECTION," filed Sep. 5, 2018, which is hereby incorporated by reference in its entirety for all purposes.

BACKGROUND

The present disclosure relates generally to heating, ventilation, and air conditioning (HVAC) systems, and more particularly, to an adapter for connecting a diffuser to a duct of the HVAC system.

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

A wide range of applications exist for HVAC systems. For example, residential, light commercial, commercial, and industrial systems are used to control temperatures and air quality in residences and buildings. Ductwork may guide the temperature controlled air flow from componentry of the HVAC system to a space being conditioned by the HVAC system. In certain embodiments, a diffuser of the HVAC system may receive the air flow from a duct of the HVAC system, and may operate to distribute the air flow to the conditioned space.

Unfortunately, duct sizes may vary across different traditional HVAC systems. Thus, traditional installation processes between ducts, such as flex ducts, and diffusers may be cumbersome and inefficient. It is now recognized that improved coupling between diffusers and ducts, such as flex ducts, of HVAC systems is desired.

SUMMARY

The present disclosure relates to an adapter for connecting a duct and a diffuser includes a base configured to be coupled to the diffuser and having a central opening. The adapter also includes a radially inner collar directly coupled to the base and extending circumferentially about a longitudinal axis of the central opening, where the radially inner collar comprises a first axial height extending from the base. The adapter also includes a radially intermediate collar directly coupled to the base, extending circumferentially about the longitudinal axis, and disposed radially outward from the radially inner collar, where the radially intermediate collar comprises a second axial height extending from the base, and wherein the second axial height is less than the first axial height. The adapter also includes a radially outer collar directly coupled to the base, extending circumferentially about the longitudinal axis, and disposed radially outward from the radially intermediate collar, wherein the radially outer collar comprises a third axial height extending from the base, and wherein the third axial height is less than the second axial height and the first axial height.

The present disclosure also relates to a duct adapter. The duct adapter includes a base surrounding a central opening having a longitudinal axis extending therethrough. The duct adapter also includes an inner collar directly coupled to the base a first radial distance from the longitudinal axis, where the inner collar extends in an axial direction parallel with the longitudinal axis. The duct adapter also includes a middle collar directly coupled to the base a second radial distance from the longitudinal axis, where the middle collar extends in the axial direction, and where a radial portion of the base extends from the inner collar to the middle collar. The duct adapter also includes an outer collar directly coupled to the base a third radial distance from the longitudinal axis, where the outer collar extends in the axial direction, where the second radial distance is greater than the first radial distance and less than the third radial distance, and where an additional radial portion of the base extends from the middle collar to the outer collar.

The present disclosure also relates to an adapter configured to couple between a duct and a diffuser. The adapter includes a ring-shaped base extending about a flow path opening. The adapter also includes a radially inner collar extending upwardly from the base and circumferentially about the flow path opening. The adapter also includes a radially intermediate collar extending upwardly from the base and circumferentially about the radially inner collar. The radially inner collar and the radially intermediate collar are coupled to opposing ends of a radial portion of the base, and the radially inner collar and the radial portion of the base are configured to be removable from the adapter. The adapter also includes a radially outer collar extending upwardly from the base and circumferentially about the radially inner collar. The radially intermediate collar and the radially outer collar are coupled to opposing ends of an additional radial portion of the base, and the radially intermediate collar and the additional radial portion of the base are configured to be removable from the adapter.

BRIEF DESCRIPTION OF THE DRAWINGS

FIG. 13 is an exploded perspective view of the duct, the diffuser, and the adapter of FIG. 12, in accordance with embodiments described herein;

FIG. 14 is an exploded side view of the duct, the diffuser, and the adapter of FIG. 13, in accordance with embodiments described herein; and FIG. 15 is a side view of the duct, the diffuser, and the adapter of FIG. 13 in assembled form, in accordance with embodiments described herein;

DETAILED DESCRIPTION

Figure 1:
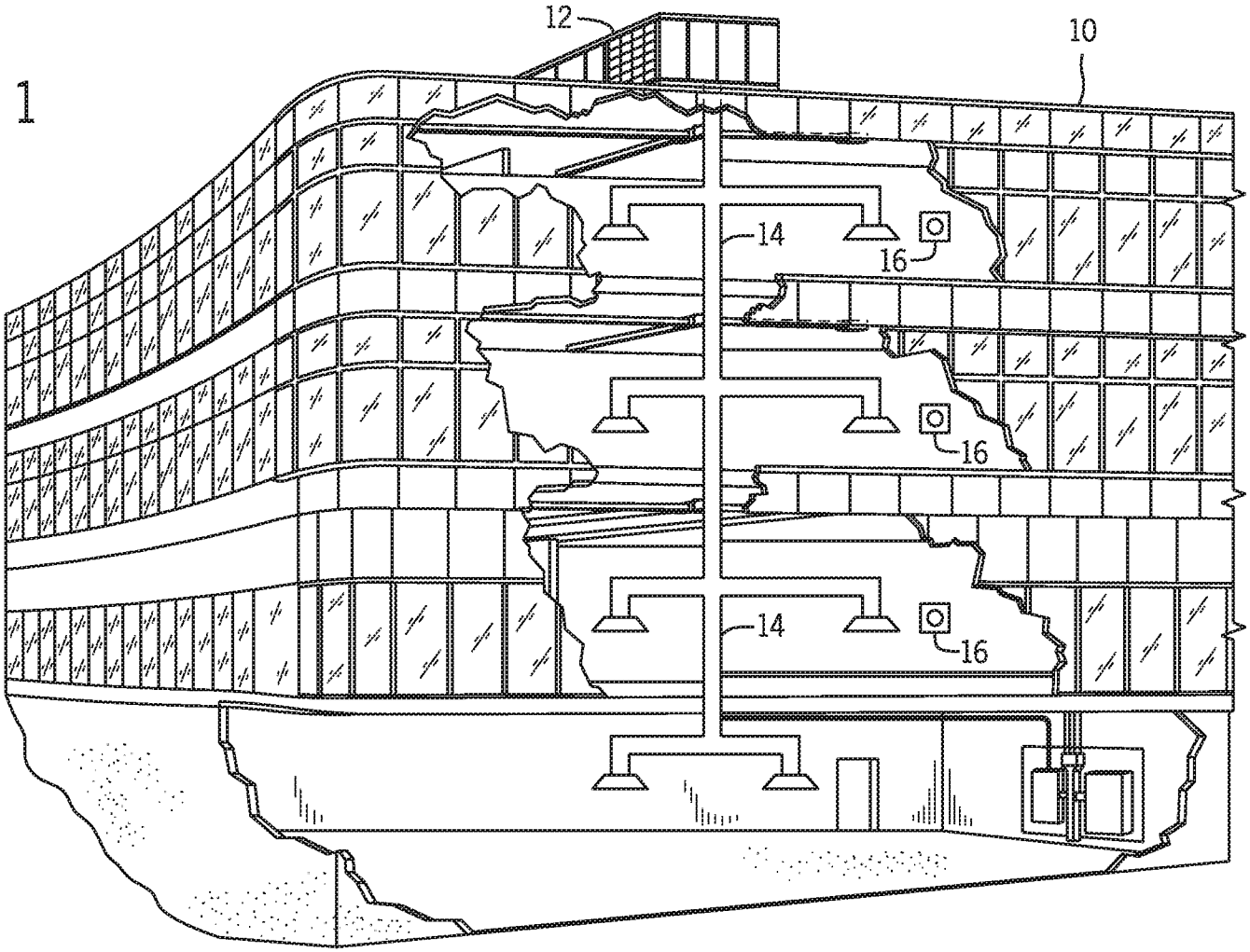
FIG. 1 is a perspective view a heating, ventilation, and air conditioning (HVAC) system for building environmental management, in accordance with embodiments described herein.

The present disclosure is directed toward heating, ventilation, and air conditioning (HVAC) systems, and more particularly, to an adapter for connecting a diffuser to a duct of the HVAC system.

A wide range of applications exist for HVAC systems. For example, residential, light commercial, commercial, and industrial systems are used to control temperatures and air quality in residences and buildings. Ductwork may guide the temperature controlled air flow from componentry of the HVAC system to a space being conditioned by the HVAC system. In certain embodiments, a diffuser of the HVAC system may receive the air flow from a duct of the HVAC system, and may operate to distribute the air flow to the conditioned space.

Depending on the embodiment, duct sizes may vary. For example, in one embodiment, a flex duct portion configured to connect to the diffuser may be generally circular, with an approximately 6 inch inner diameter. In another embodiment, the flex duct portion may include an approximately 8 inch inner diameter. In yet another embodiment, the flex duct portion may include an approximately 10 inch diameter. Diffuser connection features may be difficult to adapt to the various duct sizes. Thus, the difference in sizing of the ducts may cause HVAC installation processes, such as connection between the diffuser and the duct, to be cumbersome and inefficient.

In accordance with present embodiments, an adapter, which includes a base and several collars extending from the base, is configured to couple a diffuser to ducts, such as flex ducts, of various sizes. For example, the base may form a doughnut or washer shape which extends about an air flow opening of the adapter. A longitudinal axis may extend longitudinally through the air flow opening. The collars may extend upwardly from the base, and circumferentially along the base and about the air flow opening. For example, the adapter may include a radially inner collar extending upwardly from the base and circumferentially about the air flow opening, a radially intermediate collar extending upwardly from the base and circumferentially about the radially inner collar and air flow opening, and a radially outer collar extending upwardly from the base and circumferentially about the radially intermediate collar, the radially inner collar, and the air flow opening.

Radial portions of the base may extend between the radially inner, radially intermediate, and radially outer collars. That is, a first radial portion of the base may extend between the radially inner collar and the radially intermediate collar, and a second radial portion of the base may extend between the radially intermediate collar and the radially outer collar. The first and second radial portions of the base may each extend approximately 360 about the longitudinal axis, forming a closed loop or a substantially closed loop, and may be referred to as tear rings. In some embodiments, the tear rings may include an opening adjacent to gripping features which enable removal of the tear rings and other portions of the adapter.

The first and second radial portions, or tear rings, may also include circumferential grooves extending circumferentially about the first and second radial portions, and configured to break to enable removal of portions of the adapter. For example, certain circumferential grooves, when broken, may enable removal of the radially inner collar and the first radial portion of the base extending between the radially inner collar and the radially intermediate collar. Certain other circumferential grooves, when broken, may enable removal of the radially intermediate collar and the second radial portion of the base extending between the radially intermediate collar and the radially outer collar. If the radially inner collar and the first radial portion of the base have not already been removed, removal of the radially intermediate collar and the second radial portion of the base may also cause removal of the radially inner collar and the first radial portion of the base. As portions of the adapter are removed, a size of the air flow opening of the adapter may be expanded.

Thus, if a flex duct corresponding in size to the radially intermediate collar requires coupling to the diffuser, the radially inner collar and the first radial portion of the base of the adapter may be removed, and the flex duct may be coupled to the radially intermediate collar. Likewise, if a flex duct corresponding in size to the radially outer collar requires coupling to a diffuser, the radially inner collar, the first radial portion of the base, the radially intermediate collar, and the second radial portion of the base may be removed from the adapter, and the flex duct may be coupled to the radially outer collar. As described in detail below, the disclosed adapter, relative to traditional HVAC embodiments, may enable a more compact connection between the duct and the diffuser, reduce a part count of the HVAC system, and/or improve installation processes.

Turning now to the drawings, FIG. 1 illustrates a heating, ventilation, and/or air conditioning (HVAC) system for building environmental management that may employ an HVAC unit. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single packaged unit containing other equipment, such as a blower, integrated air handler, and/or auxiliary heating unit.

The HVAC unit 12 may be an air cooled device that provides conditioned air to the building 10. Specifically, the HVAC unit 12 may include heat exchanger coils across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may provide both heating and cooling to the building, such that the HVAC unit 12 operates in different modes.

A control device 16, one type of which may be a thermostat, may be used to designate the temperature of the conditioned air. The control device 16 also may be used to control the flow of air through the ductwork 14. For example, the control device 16 may be used to regulate operation of a component of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

In some embodiments, a duct, such as a flex duct, of the ductwork 14 may be configured to be fluidly coupled to a diffuser, which operates to distribute temperature controlled air flow to a conditioned space of the building 10. Depending on the embodiment, a size of the flex duct may vary. Thus, in accordance with the present disclosure, an adapter may be employed to reduce a part number of the system, enable a more compact connection between the flex duct and diffuser, and/or improve installation processes for fluidly coupling the flex duct and the diffuser. The adapter, diffuser features, and corresponding installation processes will be described in detail below.

Figure 2:
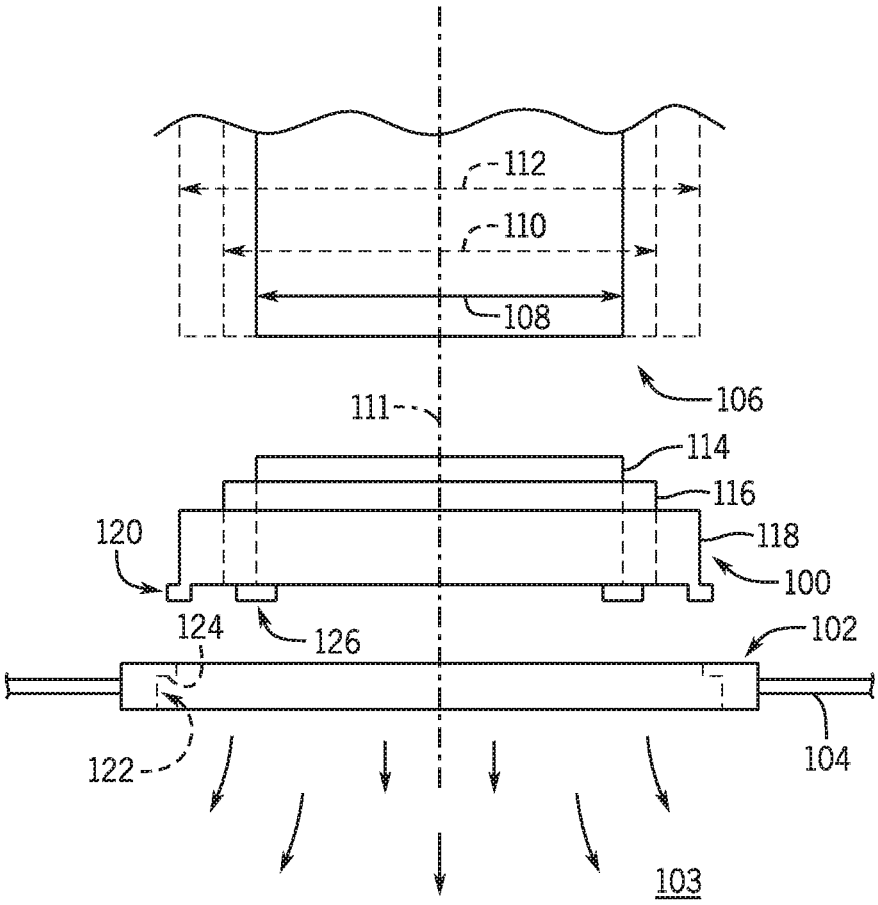
FIG. 2 is an exploded schematic view of a duct, a diffuser, and an adapter configured to connect the duct and the diffuser, for use in the HVAC system of FIG. 1, in accordance with embodiments described herein.

FIG. 2 is an exploded schematic view of an embodiment of an adapter 100, a diffuser 102 interfaced with a ceiling 104 or wall, and a duct 106, for use in the HVAC system of FIG. 1. It should be noted that the exploded schematic view of FIG. 2 is not intended to illustrate installation features or processes, and is instead intended to merely illustrate an embodiment of the adapter 100, and the components for which the adapter 100 is utilized to join, in accordance with the present disclosure.

As shown, the duct 106, such as a flex duct, includes a first inner diameter 108. The illustrated first inner diameter 108 may be, for example, approximately 6 inches. However, in other embodiments, the duct 106 may include a differently sized inner diameter 110, 112. For example, the second inner diameter 110 corresponding to a second embodiment of the duct 106 may be approximately 8 inches, and the third inner diameter 112 corresponding to a third embodiment of the duct 106 may be approximately 10 inches.

The diffuser 102 may include an opening 122 through which an air flow from the duct 106 is received. The diffuser 102 may operate to distribute the air flow to a conditioned space 103. The opening 122 of the diffuser 102 and/or other diffuser connection features may not be suitable for efficient adaptation to different sizes of the duct 106. Thus, the adapter 100 may be employed to couple the duct 106 and the diffuser 102. Indeed, the adapter 100 may include a radially inner collar 114 configured to couple to the duct 106 if the duct 106 includes the first inner diameter 108, a radially intermediate collar 116 configured to couple to the duct 106 if the duct 106 includes the second inner diameter 110, and a radially outer collar 118 configured to couple to the duct 106 if the duct 106 includes the third inner diameter 112. After fitting the duct 106 over the appropriate collar 114, 116, or 118, a zip-tie (or other coupling feature) may be employed about the duct 106 and the corresponding collar 114, 116, or 118 to couple the duct 106 thereto.

Figure 3:
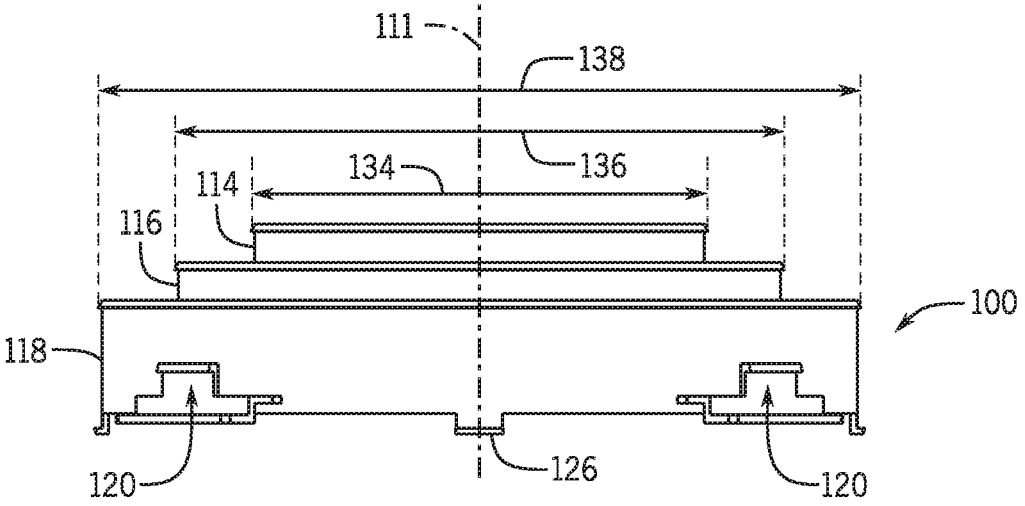
FIG. 3 is a side view of the adapter of FIG. 2, in accordance with embodiments described herein.

FIG. 3 is a side view of an embodiment of the adapter 100 of FIG. 2, and illustrates the various sizes of the collars 114, 116, 118 of the adapter 100. That is, the radially inner collar 114 includes a first outer diameter 134, the radially intermediate collar 116 includes a second outer diameter 136, and the radially outer collar 118 includes the third outer diameter 138. The first outer diameter 134 of the radially inner collar 114 of FIG. 3 is suitable for receiving an embodiment of the duct 106 of FIG. 2 whereby the duct 106 includes the first inner diameter 108 illustrated in FIG. 2. Further, the second outer diameter 136 of the radially intermediate collar 116 of FIG. 3 is suitable for receiving an embodiment of the duct 106 of FIG. 2 whereby the duct 106 includes the second inner diameter 110 illustrated in FIG. 2. Further still, the third outer diameter 138 of the radially outer collar 118 of FIG. 3 is suitable for receiving an embodiment of the duct 106 of FIG. 2 whereby the duct 106 includes the third inner diameter 112 illustrated in FIG. 2. As shown schematically in FIGS. 2 and 3, the adapter 100 may include side clips 120 configured to engage the diffuser 102 of FIG. 2, and/or feet 126 configured to engage the diffuser 102. In certain embodiments, either the feet 126 or the side clips 120 may be used for coupling the adapter 100 to the diffuser 102, as will be described in detail with reference to later drawings.

Figure 4:
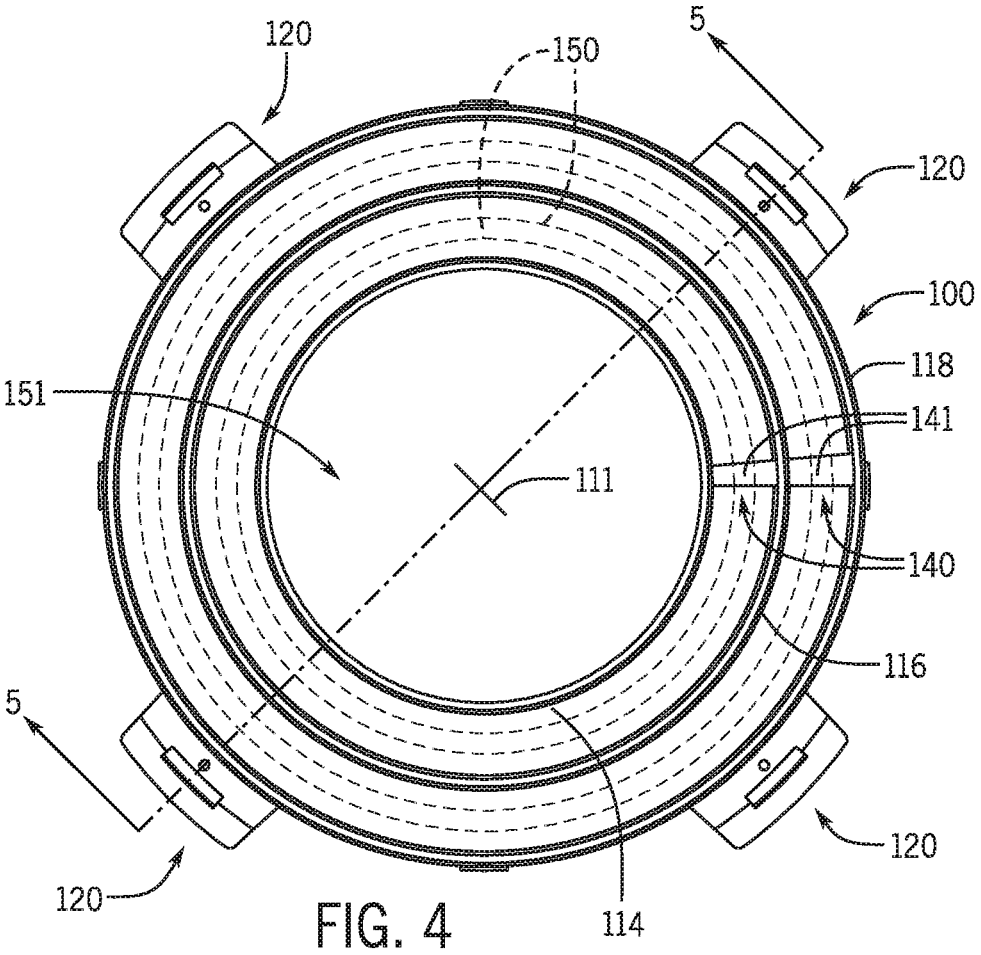
FIG. 4 is a top down view of the adapter of FIG. 2, in accordance with embodiments described herein.
Figure 5:
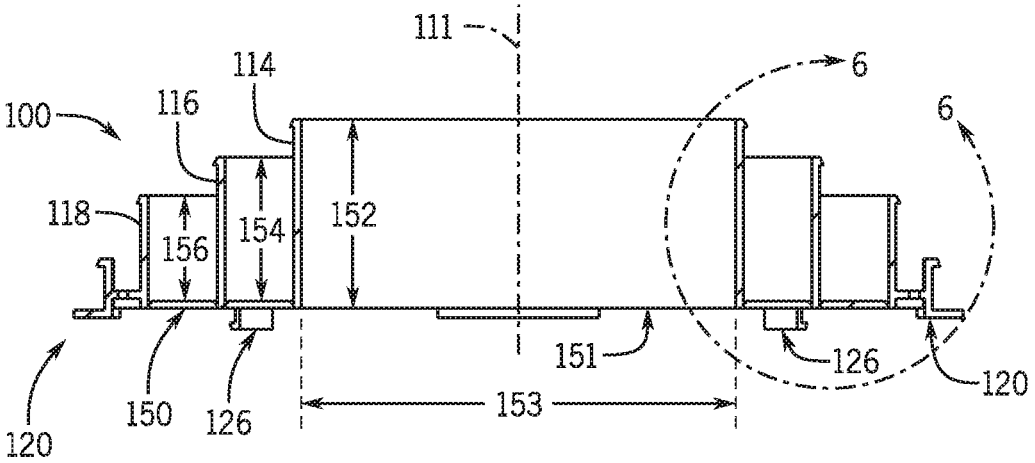
FIG. 5 is a cross-sectional view of the adapter of FIG. 4, taken along line 5-5 in FIG. 4, in accordance with embodiments described herein.

FIG. 4 is a top down view of an embodiment of the adapter 100 of FIG. 2, and FIG. 5 is a cross-sectional view of an embodiment of the adapter 100 of FIG. 4, taken along line 5-5 in FIG. 4. As shown in FIGS. 4 and 5, the adapter 100 may include an air flow path 151 having a longitudinal axis 111 extending axially therethrough. The air flow path 151 may be configured to convey a fluid flow from the aforementioned duct to the aforementioned diffuser. As shown in FIG. 4, each of the radial collars 114, 116, 118 extends circumferentially about the longitudinal axis 111 of the air flow path 151. In general, the radial collars 114, 116, 118 may extend upwardly from a base 150 of the adapter 100, where the base 150 extends in a radial direction relative to the longitudinal axis 111. In other words, the base 150 may form a ring, doughnut, or washer shape about the air flow path 151, and the radial collars 114, 116, 118 may extend upwardly, or parallel to the longitudinal axis 111, from the base 150.

For example, in FIG. 5, the radially inner collar 114 extends upwardly from the base 150 to a first height 152 above the base 150. The radially intermediate collar 116 extends upwardly from the base 150 to a second height 154 above the base 150. The radially outer collar 118 extends upwardly from the base 150 to a third height 156 above the base 150. In the illustrated embodiment, the second height 154 of the radially intermediate collar 116 is less than the first height 152 of the radially inner collar 114, and greater than the third height 156 of the radially outer collar 118. Other heights may be utilized, depending on the embodiment.

As shown in FIG. 5, the air flow path 151 may include an adjustable inner diameter 153. For example, radially inward portions of the adapter 100 can be removed from the adapter 100 in order to couple the adapter 100 to a duct. As the radially inward portions of the adapter 100 are removed, the inner diameter 153 of the air flow path 151 is expanded to correspond to the air flow path of the duct. For example, in certain connections, the radially inner collar 114 and a radial portion of the base 150 of the adapter 100 may be removed, and the duct may be coupled to the radially intermediate collar 116. In certain other connections, the radially inner collar 114, the radially intermediate collar 116, and radial portions of the base 150 of the adapter 100 may be removed, and the duct may be coupled to the radially outer collar 118. As shown in FIG. 4, pull-off tabs 140 may extend radially between the radially inner collar 114, the radially intermediate collar 116, and the radially outer collar 118. Gaps 141 may be disposed in the base 150 proximate to the pull-off tabs 140. The pull-off tabs 140 may be gripped, for example by pliers, and pulled to remove certain portions of the adapter 100 in accordance with the description above. For example, tear rings of the base 150 may be coupled to the pull-off tabs 140, and the pull-off tabs 140 may be utilized to remove the tear rings and corresponding features of the adapter 100. In some embodiments, the pull-off tabs 140 may operate in conjunction with other features of the adapter 100, for example via grooves in the base 150 which define the above-described tear rings, to facilitate removal of portions of the adapter 100, as described below.

Figure 6:
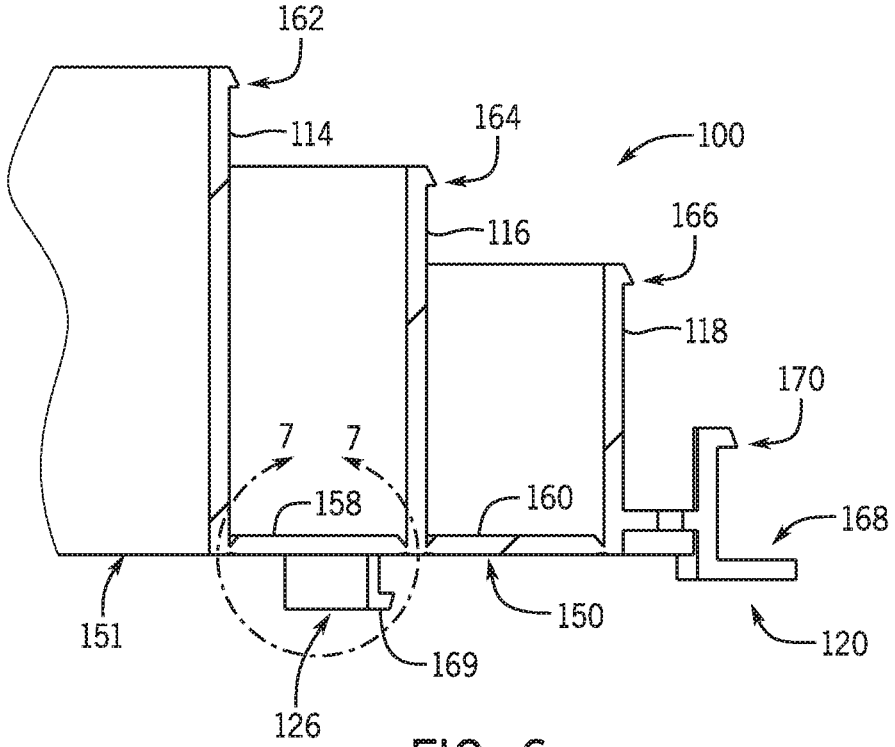
FIG. 6 is a cross-sectional view of a portion of the adapter of FIG. 5, taken along line 6-6 in FIG. 5, in accordance with embodiments described herein.

FIG. 6 is a cross-sectional view of an embodiment of a portion of the adapter 100 of FIG. 5, taken along line 6-6 in FIG. 5. In the illustrated embodiment, the adapter 100 includes a first radial portion 158 of the base 150 of the adapter 100, and a second radial portion 160 of the base 150 of the adapter 100. The first radial portion 158 extends between the radially inner collar 114 and the radially intermediate collar 116. The first radial portion 158, the radially inner collar 114, and the radially intermediate collar 116 form a U-shaped cross-sectional profile, as shown. The second radial portion 160 extends between the radially intermediate collar 116 and the radially outer collar 118. The second radial portion 160, the radially intermediate collar 116, and the radially outer collar 118 form a U-shaped cross-section profile, as shown. Grooves in the first and second radial portions 158, 160, which extend circumferentially about the air flow path 151, enable removal of portions of the adapter 100, which will be described in detail with reference to FIG. 7.

Focusing first on FIG. 6, each of the radial collars 114, 116, 118 of the adapter 100 may include gripping features for gripping an inner surface of a duct. For example, the radially inner collar 114 includes a radially inner flange 162 extending therefrom, the radially intermediate collar 116 includes a radially intermediate flange 164 extending therefrom, and the radially outer collar 118 includes a radially outer flange 166 extending therefrom. The radially inner flange 162, the radially intermediate flange 164, and the radially outer flange 166, as suggested above, are configured to grip the inner surface of the duct to which the adapter 100 is coupled.

The adapter 100 also includes features for gripping the diffuser and/or a wall. For example, depending on the embodiment of the diffuser and/or installation process, the side clips 120 of the adapter 100, which extend from or proximate to the base 150 of the adapter 100, may be used for coupling to the diffuser and/or a wall or ceiling. Further, the feet 126 of the adapter 100, which extend from or proximate to the base 150 of the adapter 100, may be used for coupling to the diffuser and/or to a wall or ceiling. In some embodiments, the adapter 100 may include only the side clips 120 or only the feet 126. In FIG. 6, the illustrated foot 126 includes a lip 169 which may engage the diffuser, and the illustrated side clip 120 includes a lower extension 168 and an upper extension 170, which may be referred to as engagement arms 168, 170, between which a portion of the diffuser and/or wall or ceiling may be sandwiched.

Figure 7:
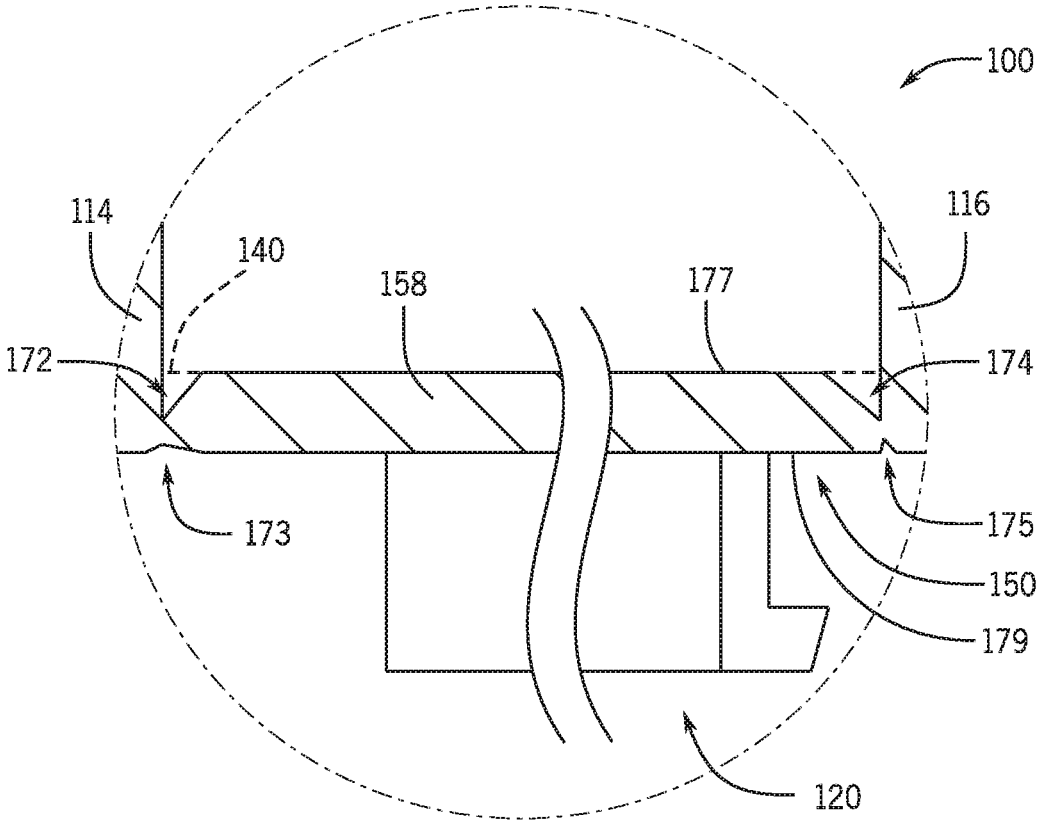
FIG. 7 is a cross-sectional view of a portion of the adapter of FIG. 6, taken along line 7-7 in FIG. 6, in accordance with embodiments described herein.

FIG. 7 is a cross-sectional view of an embodiment of a portion of the adapter 100 of FIG. 6, taken along line 7-7 in FIG. 6. As previously described, the base 150 of the adapter 100 may include radial portions extending between certain collars of the adapter 100. The illustrated embodiment includes the first radial portion 158 of the base 150 of the adapter 100, where the first radial portion 158 extends between the radially inner collar 114 and the radially intermediate collar 116. The first radial portion 158 includes a duct facing surface 177 and a diffuser facing surface 179. Grooves 172, 174, which may be referred to as circumferential grooves 172, 174, may be formed in the first radial portion 158, as shown. The circumferential grooves 172, 174 may extend circumferentially about the base 150 of the adapter 100. Additional circumferential grooves 173, 175 may be formed in the diffuser facing surface 179. The additional circumferential grooves 173, 175 may also extend circumferentially about the base 150 of the adapter 100.

The circumferential grooves 172, 174 and the additional circumferential grooves 173, 175 may operate to break to enable removal of the radially inner collar 114, the first radial portion 158 of the base 150 of the adapter 100, or both. That is, if a diffuser installation involves a flex duct corresponding in size to the radially intermediate collar 116 of the adapter 100, the radially inner collar 114 and the first radial portion 158 of the base 150 may be removed, for example via an operator manually breaking through at least the groove 174 and the additional groove 175 illustrated in FIG. 7. As previously described, a pull-off tab 140 may be formed along the first radial portion 158 of the base 150 and/or between the radially inner collar 114 and the radially intermediate collar 116, and may facilitate the above-described rupturing of the base 150 via one or more of the circumferential grooves 172, 173, 174, 175. For example, an operator may pull upwardly on the pull-off tab 140 to cause the base 150 to break or rupture along the circumferential grooves 172, 173, 174, 175, which enables removal of the desired portions of the adapter 100. The portion of the base 150 between the grooves 172, 174 and between the grooves 174, 175, referred to above as the first radial portion 158, may be referred to as a "tear ring" in conjunction with the corresponding pull-off tab 150

Figure 8:
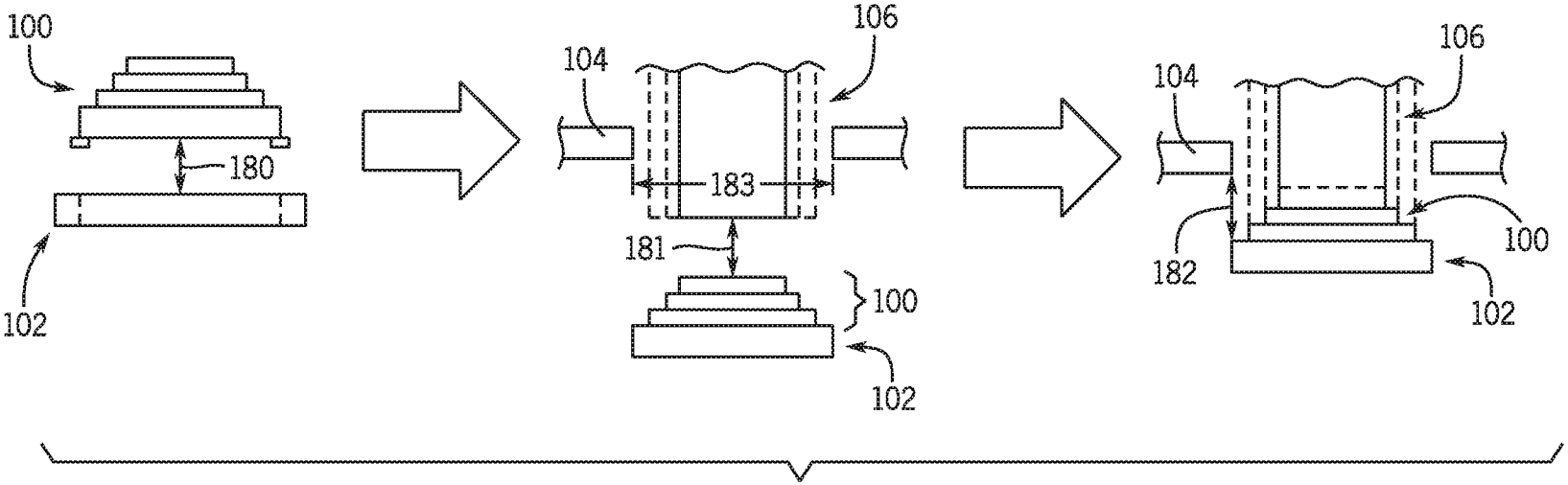
FIG. 8 is a schematic illustration of an installation process for connecting a duct and a diffuser via an adapter, in accordance with embodiments described herein.

FIG. 8 is a schematic view illustrating an embodiment of an installation process for connecting a duct 106 and a diffuser 102 via an adapter 100. The illustrated installation process may involve circumstances where the diffuser 102 is not pre-installed in the ceiling 104. For example, in the illustrated embodiment, arrow 180 signifies a coupling between the adapter 100 and the diffuser 102. That is, an operator may connect the diffuser 102 and the adapter 100 prior to the diffuser being installed in the ceiling 104.

After connecting the diffuser 102 and the adapter 100, the duct 106 may be pulled through or adjacent to an opening 183 in the ceiling 104 to facilitate coupling between the duct 106 and the adapter 100, as signified by arrow 181. In the illustrated embodiment, the duct 106 is sized to couple to the inner collar of the adapter 100; however, as described with respect to previous embodiments in which the duct 106 includes a larger diameter, portions of the adapter 100 may be removed from the adapter 100 to expand an air flow passage through the adapter 100, and the duct 106 having the larger diameter may be coupled to the intermediate or outer collar. After coupling the duct 106 and the adapter 100, the diffuser 102 may be coupled to the ceiling 104, as indicated by arrow 182. In some embodiments, the adapter 100 may couple to the ceiling 104 in addition to, instead of or in addition to the diffuser 102 being coupled to the ceiling 104.

Figure 9:
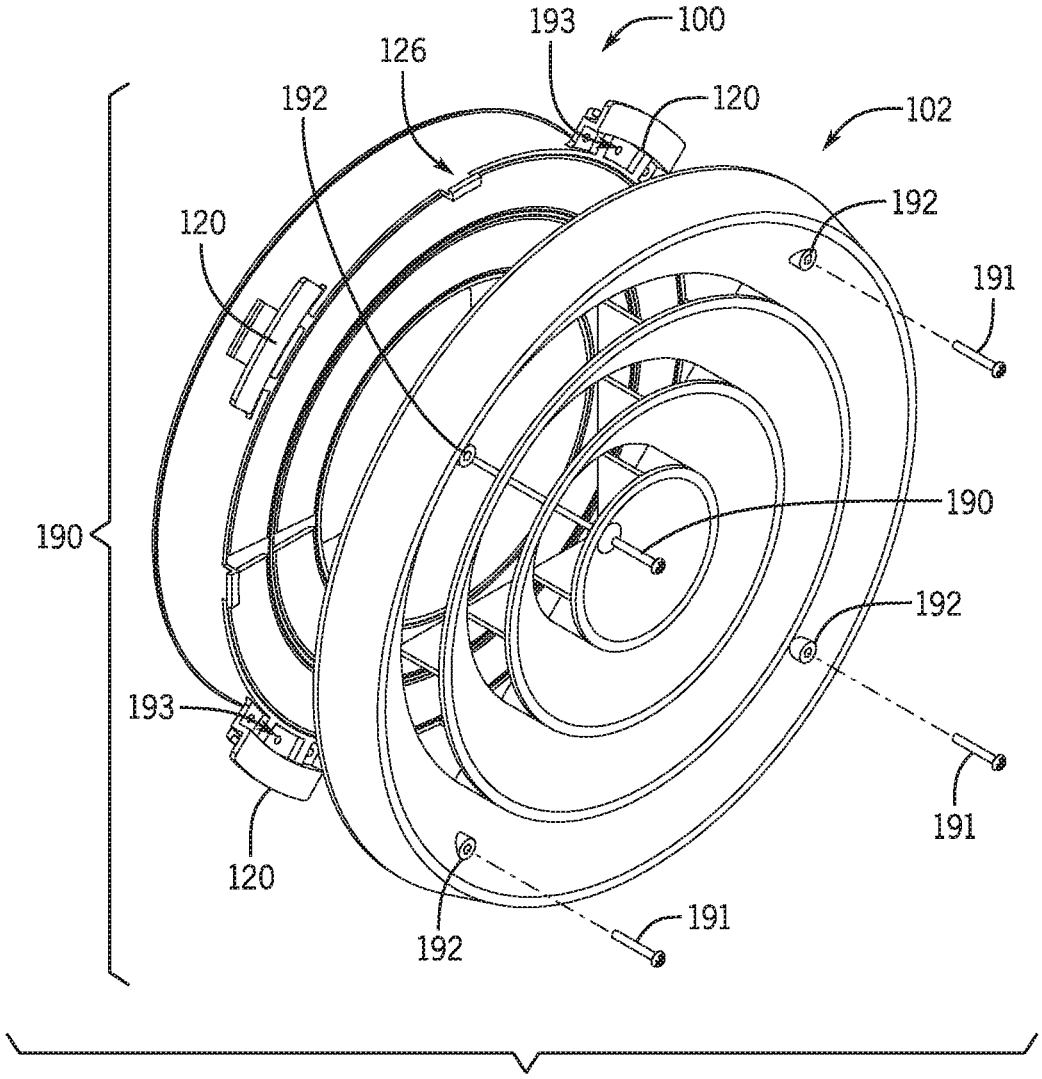
FIG. 9 is an exploded perspective view of a retrofit assembly of the adapter and the diffuser of FIG. 8, in accordance with embodiments described herein.
Figure 10:
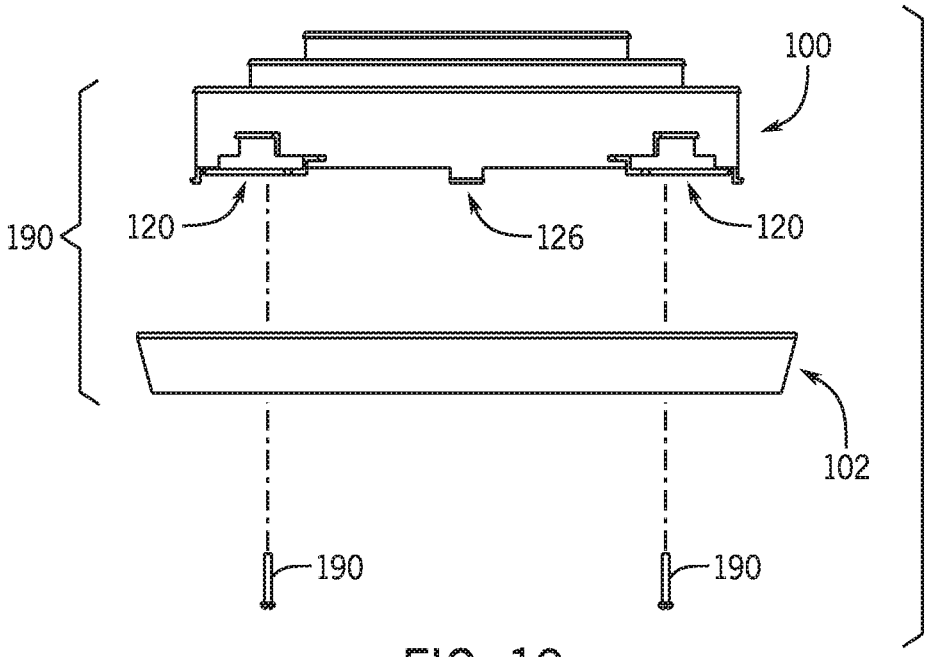
FIG. 10 is an exploded side view of the retrofit assembly of FIG. 9, in accordance with embodiments described herein.
Figure 11:
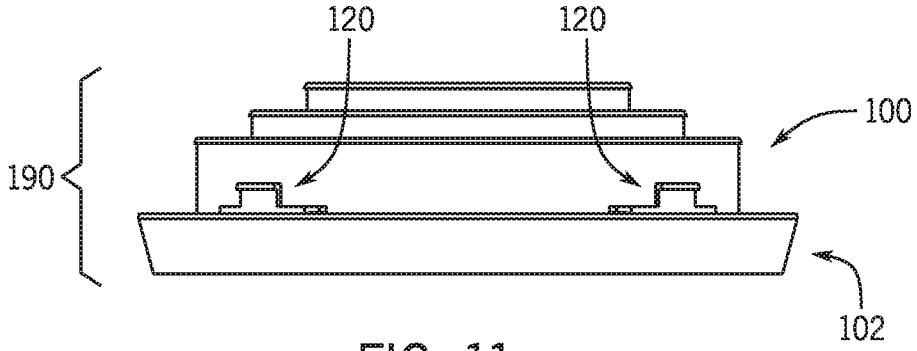
FIG. 11 is a side view of the retrofit assembly of FIG. 9 in assembled form, in accordance with embodiments described herein.

FIG. 9 is an exploded perspective view of an embodiment of a retrofit assembly 190 having the adapter 100 and the diffuser 102, for use in the installation process illustrated in FIG. 8. FIG. 10 is an exploded side view of the retrofit assembly 190 of FIG. 9, and FIG. 11 is a side view of an embodiment of the retrofit assembly 190 of FIG. 9 in assembled form. It should be noted that other assemblies may also be possible, and that the retrofit assembly 190 described in detail below is provided as one example suitable for the installation process illustrated in FIG. 8 and described above.

Focusing in particular on FIG. 9, the retrofit assembly 190 may include the adapter 100 and the diffuser 102, where the diffuser 102 includes through holes 192 (or openings) configured to receive fasteners 191. The side clips 120 of the adapter 100, or another portion of the adapter 100, may also include through holes 193 configured to receive the fasteners 191. The fasteners 191 and the through holes 192, 193 may be threaded, such that the fasteners 191 are retained within the through holes 192, 193. In the illustrated embodiment, the side clips 120 of the adapter 100 may be configured to engage a wall or ceiling in which the retrofit assembly 190 is configured to be installed. A detailed description of the side clips 120 and corresponding features is set forth above with respect to FIG. 6. In some embodiments, the fasteners 191 may extend through the side clips 120 and into the wall or ceiling to further solidify an installation of the retrofit assembly 190. Further, in some embodiments, the feet 126 of the adapter 100 may be utilized to engage the diffuser 102 or wall. For example, as illustrated in FIG. 11, in which the retrofit assembly 190 is in assembled form, the side clips 120 may at least partially define a gap for receiving a thickness of the wall or ceiling. The side clips 120 may also be coupled to the diffuser 102 via the fasteners 191 illustrated in FIG. 9.

Figure 12:
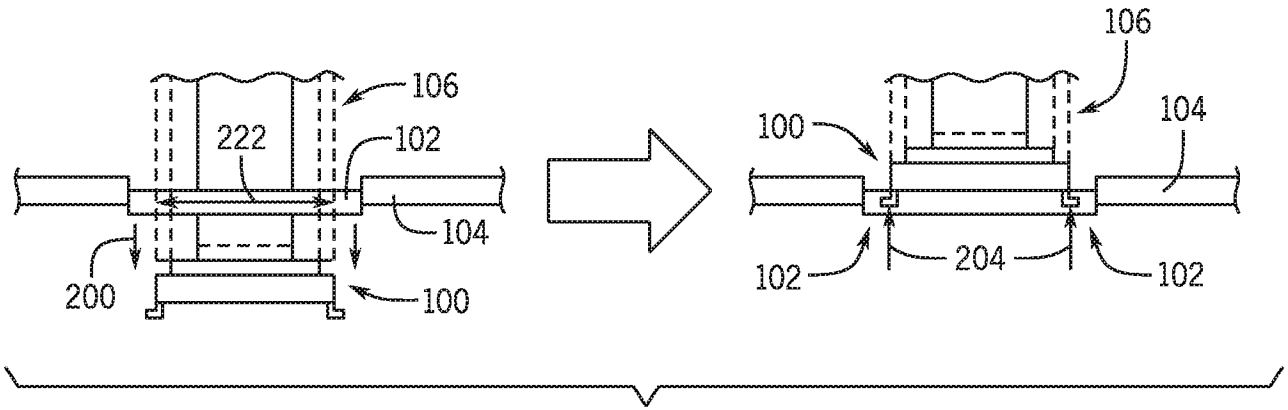
FIG. 12 is a schematic illustration of an installation process for connecting a duct and a diffuser via an adapter, whereby the diffuser is pre-installed in a ceiling, in accordance with embodiments described herein.

FIG. 12 is a schematic view illustrating an embodiment of an installation process for connecting a duct 106 and a diffuser 102 via an adapter 100, whereby the diffuser 102 is pre-installed in a ceiling 104. For example, as shown, the diffuser 102 may be installed in the ceiling 104 and may include a diffuser opening 202 that enables the duct 106 to be pulled through the diffuser 102 toward and onto the adapter 100, as indicated by arrows 200. The diffuser 102 may include, for example, a lid or cover that, when removed, enables access to the diffuser opening 202. The illustrated duct 106 is coupled to the radially inner collar of the adapter 100. However, as noted with respect to earlier drawings, portions of the adapter 100 may be removed in embodiments where the duct 106 includes a larger diameter than shown in the illustrated embodiment.

After coupling the duct 106 and the adapter 100, the duct 106 and the adapter 100 may be moved upwardly, as indicated by arrows 204, such that the adapter 100 can be coupled to the diffuser 102, which is already installed in the ceiling 104 or wall as noted above.

FIG. 13 is an exploded perspective view of an embodiment of the duct 106, the diffuser 102, and the adapter 100 for use in the installation process of FIG. 12. FIG. 14 is an exploded side view of an embodiment of the duct 106, the diffuser 102, and the adapter 100 of FIG. 13. FIG. 15 is a side view of an embodiment of the duct 106, the diffuser 102, and the adapter 100 of FIG. 13 in assembled form. It should be noted that other components and assemblies may also be possible, and that the components described in detail below are provided as one example suitable for use in the installation process illustrated in FIG. 12 and described above.

The diffuser 102 may include a lid 215 (shown in FIGS. 14 and 15) which is configured to cover an outlet opening 211 of the diffuser 102. An opposing end of the diffuser 102 may include an inlet opening 210. Thus, when the lid 215 of the diffuser 102 is removed, the duct 106 can extend through a thickness of the diffuser 102 for coupling to the adapter 100. The lid 215 may include features which, when an air flow pass thereover, causes a desired distribution of the air flow to the conditioned space. For example, the lid 215 may have features such as slats which increase a static pressure and reduce a velocity of the air flow.

After the duct 106 is coupled to the adapter 100, the adapter 100 may be moved through the outlet opening 211 and toward the inlet opening 210 of the diffuser 102. As previously described, the side clips 120 of the adapter 100, the feet 126 (shown in FIGS. 13 and 14) of the adapter 100, or any combination thereof may be utilized to couple the adapter 100 to the diffuser 102 adjacent the inlet opening 210.

In accordance with the present disclosure, an adapter for connecting a diffuser and a duct may include portions which can be removed based on differences in duct sizing. By including a single, compact adapter, installation processes are simplified and made more efficient, and a part number of the system may be reduced.

While only certain features and embodiments of the disclosure have been illustrated and described, many modifications and changes may occur to those skilled in the art, such as variations in sizes, dimensions, structures, shapes and proportions of the various elements, values of parameters including temperatures and pressures, mounting arrangements, use of materials, colors, orientations, etc., without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. An adapter for connecting a duct and a diffuser, comprising:

a base configured to be coupled to the diffuser and having a central opening;

a radially inner collar directly coupled to the base and extending circumferentially about a longitudinal axis of the central opening, wherein the radially inner collar comprises a first axial height extending from the base;

a radially intermediate collar directly coupled to the base, extending circumferentially about the longitudinal axis, and disposed radially outward from the radially inner collar, wherein the radially intermediate collar comprises a second axial height extending from the base, and wherein the second axial height is less than the first axial height; and a radially outer collar directly coupled to the base, extending circumferentially about the longitudinal axis, and disposed radially outward from the radially intermediate collar, wherein the radially outer collar comprises a third axial height extending from the base, and wherein the third axial height is less than the second axial height and the first axial height, wherein the base comprises a radial portion extending between the radially inner collar and the radially intermediate collar, wherein the radial portion is configured to be removable from the adapter; and an additional radial portion extending between the radially intermediate collar and the radially outer collar, wherein the additional radial portion is configured to be removable from the adapter.

2. The adapter of claim 1, wherein the radial portion of the base, the radially inner collar, and the radially intermediate collar form a U-shaped cross-sectional profile, and wherein the additional radial portion of the base, the radially intermediate collar, and the radially outer collar form an additional U-shaped cross-sectional profile.

3. An adapter for connecting a duct and a diffuser, comprising:

a base configured to be coupled to the diffuser and having a central opening;

a radially inner collar directly coupled to the base and extending circumferentially about a longitudinal axis of the central opening, wherein the radially inner collar comprises a first axial height extending from the base;

a radially intermediate collar directly coupled to the base, extending circumferentially about the longitudinal axis, and disposed radially outward from the radially inner collar, wherein the radially intermediate collar comprises a second axial height extending from the base, and wherein the second axial height is less than the first axial height; and a radially outer collar directly coupled to the base, extending circumferentially about the longitudinal axis, and disposed radially outward from the radially intermediate collar, wherein the radially outer collar comprises a third axial height extending from the base, and wherein the third axial height is less than the second axial height and the first axial height, wherein the base comprises at least one of (a) a circumferential groove extending about the longitudinal axis and disposed at, or immediately adjacent to and radially inward from, a connection between the base and the radially intermediate collar, wherein the circumferential groove is configured to break the connection to enable removal of the radially inner collar and a portion of the base, and (b) a circumferential groove extending about the longitudinal axis and disposed at, or immediately adjacent to and radially inward from, a connection between the base and the radially outer collar, wherein the circumferential groove is configured to break the connection to enable removal of the radially intermediate collar and a portion of the base from the adapter.

4. An adapter for connecting a duct and a diffuser, comprising:

a base configured to be coupled to the diffuser and having a central opening;

a radially inner collar directly coupled to the base and extending circumferentially about a longitudinal axis of the central opening, wherein the radially inner collar comprises a first axial height extending from the base;

a radially intermediate collar directly coupled to the base, extending circumferentially about the longitudinal axis, and disposed radially outward from the radially inner collar, wherein the radially intermediate collar comprises a second axial height extending from the base, and wherein the second axial height is less than the first axial height; and a radially outer collar directly coupled to the base, extending circumferentially about the longitudinal axis, and disposed radially outward from the radially intermediate collar, wherein the radially outer collar comprises a third axial height extending from the base, and wherein the third axial height is less than the second axial height and the first axial height, the adapter including a pull-off tab extending in a radial direction, with respect to the longitudinal axis, between at least one of (a) the radially inner collar and the radially intermediate collar and (b) the radially intermediate collar and the radially outer collar.

5. The adapter of claim 4, wherein the pull-off tab extending between the radially inner collar and the radially intermediate collar is coupled to the base between the radially inner collar and the radially intermediate collar and is configured to be pulled away from the adapter to remove the radially inner collar and a portion of the base from the adapter.

6. The adapter of claim 4, wherein the base comprises a gap disposed immediately adjacent to the pull-off tab.

7. The adapter of claim 4, wherein the pull-off tab extending between the radially intermediate collar and the radially outer collar is coupled to the base between the radially intermediate collar and the radially outer collar and is configured to be pulled away from of the adapter to remove the radially intermediate collar and a portion of the base from the adapter.

8. An adapter for connecting a duct and a diffuser, comprising:

a base configured to be coupled to the diffuser and having a central opening;

a radially inner collar directly coupled to the base and extending circumferentially about a longitudinal axis of the central opening, wherein the radially inner collar comprises a first axial height extending from the base;

a radially intermediate collar directly coupled to the base, extending circumferentially about the longitudinal axis, and disposed radially outward from the radially inner collar, wherein the radially intermediate collar comprises a second axial height extending from the base, and wherein the second axial height is less than the first axial height; and a radially outer collar directly coupled to the base, extending circumferentially about the longitudinal axis, and disposed radially outward from the radially intermediate collar, wherein the radially outer collar comprises a third axial height extending from the base, and wherein the third axial height is less than the second axial height and the first axial height, wherein at least one of (a) the radially inner collar is configured to receive the duct having a 6 inch inner diameter, (b) the radially intermediate collar is configured to receive the duct having an 8 inch inner diameter and (c) the radially outer collar is configured to receive the duct having a 10 inch inner diameter.

9. An adapter for connecting a duct and a diffuser, comprising:

a base configured to be coupled to the diffuser and having a central opening;

a radially inner collar directly coupled to the base and extending circumferentially about a longitudinal axis of the central opening, wherein the radially inner collar comprises a first axial height extending from the base;

a radially intermediate collar directly coupled to the base, extending circumferentially about the longitudinal axis, and disposed radially outward from the radially inner collar, wherein the radially intermediate collar comprises a second axial height extending from the base, and wherein the second axial height is less than the first axial height; and a radially outer collar directly coupled to the base, extending circumferentially about the longitudinal axis, and disposed radially outward from the radially intermediate collar, wherein the radially outer collar comprises a third axial height extending from the base, and wherein the third axial height is less than the second axial height and the first axial height, wherein the adapter includes side clips extending from the base of the adapter radially outward from the radially outer collar, wherein the side clips are circumferentially spaced about the longitudinal axis, and wherein each side clip comprises engagement arms configured to engage the diffuser or a wall in which the diffuser is disposed.

* * * * *